US011142948B2

(12) United States Patent
Oh et al.

(10) Patent No.: US 11,142,948 B2
(45) Date of Patent: Oct. 12, 2021

(54) ACCESS CONTROL APPARATUS

(71) Applicants: CRUCIALTEC CO. LTD, Seongnam-si (KR); CRUCIALTRAK, INC, Seongnam-si (KR)

(72) Inventors: Dong Hyun Oh, Seoul (KR); Yong Hee Han, Gwangju-si (KR); Dong Ho Lee, Seongnam-si (KR)

(73) Assignees: CRUCIALTEC CO. LTD, Seongnam-si (KR); CRUCIALTRAK, INC, Seongnam-si (KR)

( * ) Notice: Subject to any disclaimer, the term of this patent is extended or adjusted under 35 U.S.C. 154(b) by 0 days.

(21) Appl. No.: 16/628,910

(22) PCT Filed: Jun. 25, 2018

(86) PCT No.: PCT/KR2018/007148
§ 371 (c)(1),
(2) Date: Jan. 6, 2020

(87) PCT Pub. No.: WO2019/009550
PCT Pub. Date: Jan. 10, 2019

(65) Prior Publication Data

US 2020/0123854 A1 Apr. 23, 2020

(30) Foreign Application Priority Data

Jul. 4, 2017 (KR) ..... 10-2017-0084585

(51) Int. Cl.
*G08B 13/08* (2006.01)
*E06B 11/02* (2006.01)
(Continued)

(52) U.S. Cl.
CPC ..... *E06B 11/022* (2013.01); *E05F 15/60* (2015.01); *E05F 15/73* (2015.01); *E05Y 2900/40* (2013.01)

(58) Field of Classification Search
CPC ..... E06B 11/022; E06B 11/00; E06B 11/085; E06B 11/02; E05F 15/60; E05F 15/00;
(Continued)

(56) References Cited

U.S. PATENT DOCUMENTS 7,168,477 B2 * 1/2007 Salice ..... E05D 15/262 160/213
9,085,926 B2 * 7/2015 Collinson ..... E05F 15/605
(Continued)

FOREIGN PATENT DOCUMENTS

CA 2819680 * 9/2014 ..... E05D 15/26
JP 10-153039 A 6/1998
(Continued)

*Primary Examiner* — Chi Q Nguyen
(74) *Attorney, Agent, or Firm* — Novick, Kim & Lee, PLLC; Jae Youn Kim; Jihun Kim

(57) ABSTRACT

Disclosed is an access control apparatus according to the present invention. The access control apparatus includes: a body located on a passage; an opening and closing part coupled to the body and having a folding arm adapted to open and close the passage; and a driving part coupled to the body to control an operation of the opening and closing part, wherein the folding arm includes a first link whose one end is rotatably coupled to the body and a second link whose one end is coupled to the body in such a manner as to be straightly moved by means of the driving part and whose other end is foldably coupled to the other end of the first link.

14 Claims, 10 Drawing Sheets

(51) Int. Cl.
*E05F 15/60* (2015.01)
*E05F 15/73* (2015.01)

(58) Field of Classification Search
CPC ... E05F 15/63; E05F 15/73; E05F 1/00; E05F 1/08; G07C 9/00; E05Y 2900/40; E05Y 2900/402; E05Y 2900/531
USPC ..... 49/13, 26, 28, 44, 53, 381
See application file for complete search history.

(56) References Cited

U.S. PATENT DOCUMENTS

| | | | | |
|---|---|---|---|---|
| 10,415,301 | B2 * | 9/2019 | Kuan | E05C 1/065 |
| 2013/0212948 | A1 * | 8/2013 | Nixon | E05F 3/225 49/349 |
| 2013/0305867 | A1 * | 11/2013 | Doggett | B25J 18/00 74/490.04 |
| 2014/0137474 | A1 * | 5/2014 | Suzuki | E05B 81/14 49/31 |
| 2017/0335611 | A1 * | 11/2017 | Brunnmayr | E05D 7/00 |
| 2017/0350185 | A1 * | 12/2017 | Kuan | E05B 65/06 |
| 2018/0014989 | A1 * | 1/2018 | Levine | A61G 5/104 |
| 2018/0142512 | A1 * | 5/2018 | Dillinger | B60Q 9/00 |
| 2019/0345765 | A1 * | 11/2019 | Glayse | E06B 11/085 |

FOREIGN PATENT DOCUMENTS

| | | | |
|---|---|---|---|
| JP | 2001-504560 | A | 4/2001 |
| KR | 1998-0028176 | U | 8/1998 |
| KR | 20-0294540 | Y1 | 11/2002 |
| KR | 10-1439348 | B1 | 11/2014 |

* cited by examiner

ACCESS CONTROL APPARATUS

TECHNICAL FIELD

The present invention relates to an access control apparatus, and more particularly, to an access control apparatus that is capable of adjusting an installation width and increasing an operating speed through an opening and closing part having a link structure.

BACKGROUND ART

An access control apparatus is generally located on an entrance side of a building or subway station so as to admit accesses to only persons having a given requirement for the access to the building or subway station. The access control apparatus is called access gate. Generally, the access gate is operated to allow a door (opening and closing part) to be open if a security card of a user comes into contact therewith. Recently, an access gate has been developed to allow a door to be open through biological identification information like a user's finger print.

Examples of the access gate include a turn type gate, a slide type gate, a swing type gate, and so on.

The turn type gate has a plurality of bars mounted thereon in such a manner as to be rotatable by a shaft. The turn type gate has an advantage like a low installation cost, but inconveniently, users have to directly push the bars so as to pass through the gate.

So as to remove such inconveniences, recently, the slide type gate with an automatically sliding door and the swing type gate with a door rotating around a rotary shaft have been adopted widely.

One of main standards for estimating the performance of the access gate is a handling capacity. The handling capacity of the access gate is determined according to a driving speed of the door (opening and closing part) and a size of the gate. If the driving speed of the door is fast, in detail, the number of persons passing through the gate within given time can be increased, and if the size of the gate is small, a plurality of access gates can be located within a restricted area, thereby increasing the number of persons passing through the gates.

Also, the durability of the access gate, especially, the durability of the door (opening and closing part) has a big influence on the maintenance cost of the access gate, and accordingly, the durability of the access gate becomes one of the standards for estimating the performance of the access gate. If the door is repaired because of its failure, the handling capacity of the access gate becomes greatly decreased.

FIG. 1 is a sectional view showing a conventional slide type gate. As shown in FIG. 1, the conventional slide type gate is configured to have a given sized door (opening and closing part) D inserted into a body B. As a result, a width of the body B is equal to or larger than a width of the door D, which causes a limitation in reducing the width of the body B. Further, there is a limitation in increasing a driving speed of the door D due to a structure in which the door D slides to left and right sides, and also, durability of the door D is not good.

The conventional access gate cannot satisfy sufficient handling capacity and durability conditions, and of course, even the turn type gate or swing type gate not shown cannot satisfy the conditions.

In addition, the conventional access gates have various problems. For example, they are configured to have the given sized door coupled to the body, thereby making it basically impossible to freely adjust the installation width thereof. So as to build passages (lanes) having various sizes, in detail, access gates (or doors) manufactured separately according to the widths of the passages have to be needed.

Therefore, there is a need for development of a new access gate structure capable of solving such technical problems occurring in the art.

(Patent Document 1) Korean Patent No. 10-0796273 (entitled 'Access apparatus for ticket gate operated simultaneously by belt')

DISCLOSURE

Technical Problem

Accordingly, the present invention has been made in view of the above-mentioned problems occurring in the related art, and it is an object of the present invention to provide an access control apparatus that is capable of improving a driving speed of an opening and closing part, reducing an installation width thereof, and increasing a handling capacity thereof.

It is another object of the present invention to provide an access control apparatus that is capable of having excellent durability, high reliability, and many economical advantages.

It is yet another object of the present invention to provide an access control apparatus that is capable of freely setting an installation width thereof and handling various passage widths with one model thereof.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to one aspect of the present invention, there is provided an access control apparatus including: a body located on a passage; an opening and closing part coupled to the body and having a folding arm adapted to open and close the passage; and a driving part coupled to the body to control an operation of the opening and closing part, wherein the folding arm includes a first link whose one end is rotatably coupled to the body and a second link whose one end is coupled to the body in such a manner as to be straightly moved by means of the driving part and whose other end is foldably coupled to the other end of the first link.

According to the present invention, desirably, the body includes a support frame having an accommodation space adapted to allow the opening and closing part and the driving part to be detachably attached or inserted thereinto, the opening and closing part further includes a pressure sensor disposed on one side of the folding arm, and the folding arm further includes a rotary member having a circular shape in such a manner as to be coupled to the other end of the first link and to the other end of the second link to connect the first link and the second link.

According to the present invention, desirably, the accommodation space and the opening and closing part detachably attached or inserted into the accommodation space are located symmetrically on both surfaces of the support frame around the support frame.

According to the present invention, desirably, if the opening and closing part is closed by means of the driving part, one end of the second link is moved to one end of the first link to allow a portion of the folding arm at which the rotary member is located to protrude in one way so that the folding arm is changed into a folded structure, and if the opening and closing part is open by means of the driving part, one end of the second link is moved to the opposite direction to one end of the first link to allow the protruding portion of the folding arm to be moved to the opposite direction to one way so that the folding arm is changed into an unfolded structure.

According to the present invention, desirably, the opening and closing part further includes an articulated type slider located in the accommodation space in such a manner as to be rotatably coupled to the first link, and the articulated type slider has a shoulder joint structure so that if the folding arm with a straight structure in which the first link, the second link, and the rotary member are arranged in series is located in the accommodation space, the articulated type slider allows the folding arm to be changed into the folded structure from the straight structure through the driving part.

According to the present invention, desirably, the driving part further includes a pushing module adapted to push the folding arm toward the outside of the accommodation space if the folding arm with the straight structure in which the first link, the second link, and the rotary member are arranged in series is located in the accommodation space, so that the folding arm is changed from the straight structure into the folded structure.

According to the present invention, desirably, the driving part includes a linear type motor and controls the operation of the opening and closing part through the linear type motor.

According to the present invention, desirably, the access control apparatus further includes a sound part adapted to provide predetermined sounds to a user of the access control apparatus, while the opening and closing part is being controlled by means of the driving part.

According to the present invention, desirably, the access control apparatus further includes a recognizing part located on one side thereof and having at least one or more modules selected from a finger print recognizing module for recognizing the finger print of the user of the access control apparatus, a vein recognizing module for recognizing the vein shape of the user of the access control apparatus, an iris recognizing module for recognizing the iris of the user of the access control apparatus, and a face recognizing module for recognizing the facial shape of the user of the access control apparatus so as to recognize the user of the access control apparatus, so that if the recognized user of the access control apparatus is an access-admitted person, the access control apparatus opens the opening and closing part by means of the driving part.

According to the present invention, desirably, the access control apparatus further includes a guiding part adapted to guide the use of the access control apparatus and having a first sensing module disposed on one end of the support frame to sense one user of the access control apparatus, a second sensing module disposed on the other end of the support frame symmetrical to one end of the support frame to sense the other user of the access control apparatus, and access guiding modules for guiding accesses to the access control apparatus, so that if any one of the first sensing module and the second sensing module senses one user, the guiding part guides the sensed user to the access control apparatus through the corresponding access guiding module, and if both of the first sensing module and the second sensing module sense the users, the guiding part guides the first sensed user in the sensed order to the access control apparatus through the corresponding access guiding module or guides the closer user on the basis of the sensed distance to the access control apparatus through the corresponding access guiding module.

According to the present invention, desirably, the access guiding modules provide first access to the access control apparatus for one user or the other user by means of lighting of LEDs toward one user or the other user or guide one user and the other user to different ways.

To accomplish the above-mentioned objects, according to another aspect of the present invention, there is provided an access control system including the plurality of access control apparatuses according to one aspect of the present invention, wherein the plurality of access control apparatuses is spaced apart from each other by given distances, and the given distances are set by controlling protruding lengths of the folding arms of the plurality of access control apparatuses.

Advantageous Effects

According to the present invention, the access control apparatus can improve a driving speed of the opening and closing part, reduce an installation width thereof, and increase a handling capacity thereof.

In addition, the access control apparatus according to the present invention can enhance durability, reliability, and economical effects thereof.

Also, the access control apparatus according to the present invention can freely set an installation width thereof and handle various passage widths.

Further, the access control apparatus according to the present invention can be provided with the recognizing part capable of performing recognition for finger print, vein shape, iris shape, and facial shape, thereby enhancing a security level of the access control apparatus and making it unnecessary to use a security card upon the access to the access control apparatus.

Furthermore, the access control apparatus according to the present invention can be provided with the guiding part capable of indicating first access to one user among a plurality of users or guiding the plurality of users to different ways.

The effects of the invention are not limited as mentioned above, and it should be understood that the effects of the invention include all effects inferable from the detailed description and claims of the present invention.

MODE FOR INVENTION

Figure 1:
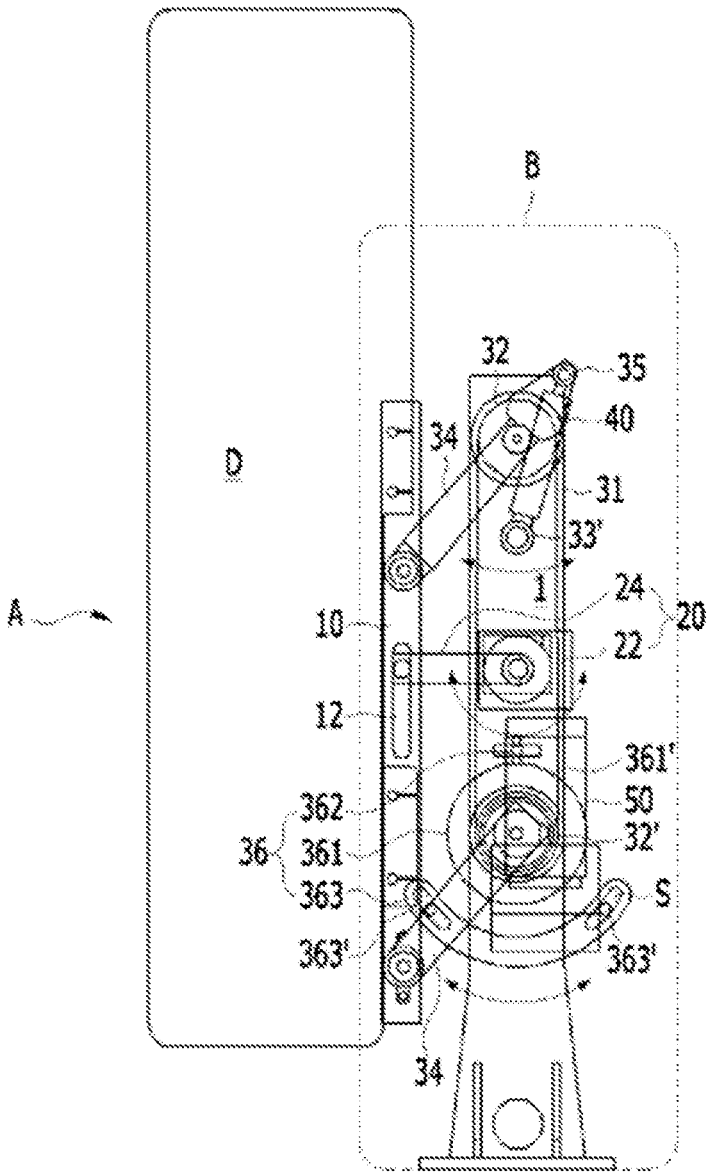
FIG. 1 PRIOR ART
FIG. 1 is a sectional view showing a conventional slide type gate.

Hereinafter, the present invention will be in detail explained with reference to the attached drawings.

The present invention may be modified in various ways and may have several exemplary embodiments. The following drawings herein illustrate preferred embodiments of the present invention and serve to facilitate the general understanding of the scope of the present invention, together with the detailed description of the present invention. Therefore, the present invention is not limitedly interpreted only with the attached drawings. However, it should be understood that the invention covers all the modifications, equivalents, and replacements within the idea and technical scope of the invention. In order to facilitate the general understanding of the present invention in describing the present invention, through the accompanying drawings, the same reference numerals will be used to describe the same components and an overlapped description of the same components will be omitted.

The term 'modules', and 'parts', as used herein, are used only for the description of the present invention, and therefore, they do not have any distinguishing meaning or roles. If it is determined that the detailed explanation on the well known technology related to the present invention makes the scope of the present invention not clear, the explanation will be avoided for the brevity of the description.

In the description, when it is said that one element is described as being "connected" or "coupled" to the other element, one element may be directly connected or coupled to the other element, but it should be understood that another element may be present between the two elements. When it is said that one portion is described as "includes" any component, further, one element further may include other components unless no specific description is suggested.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Terms, such as the first, the second, A, and B, may be used to describe various elements, but the elements should not be restricted by the terms. The terms are used to only distinguish one element from the other element. For example, a first element may be named a second element without departing from the scope of the present invention. Likewise, a second element may be named a first element.

Figure 2:
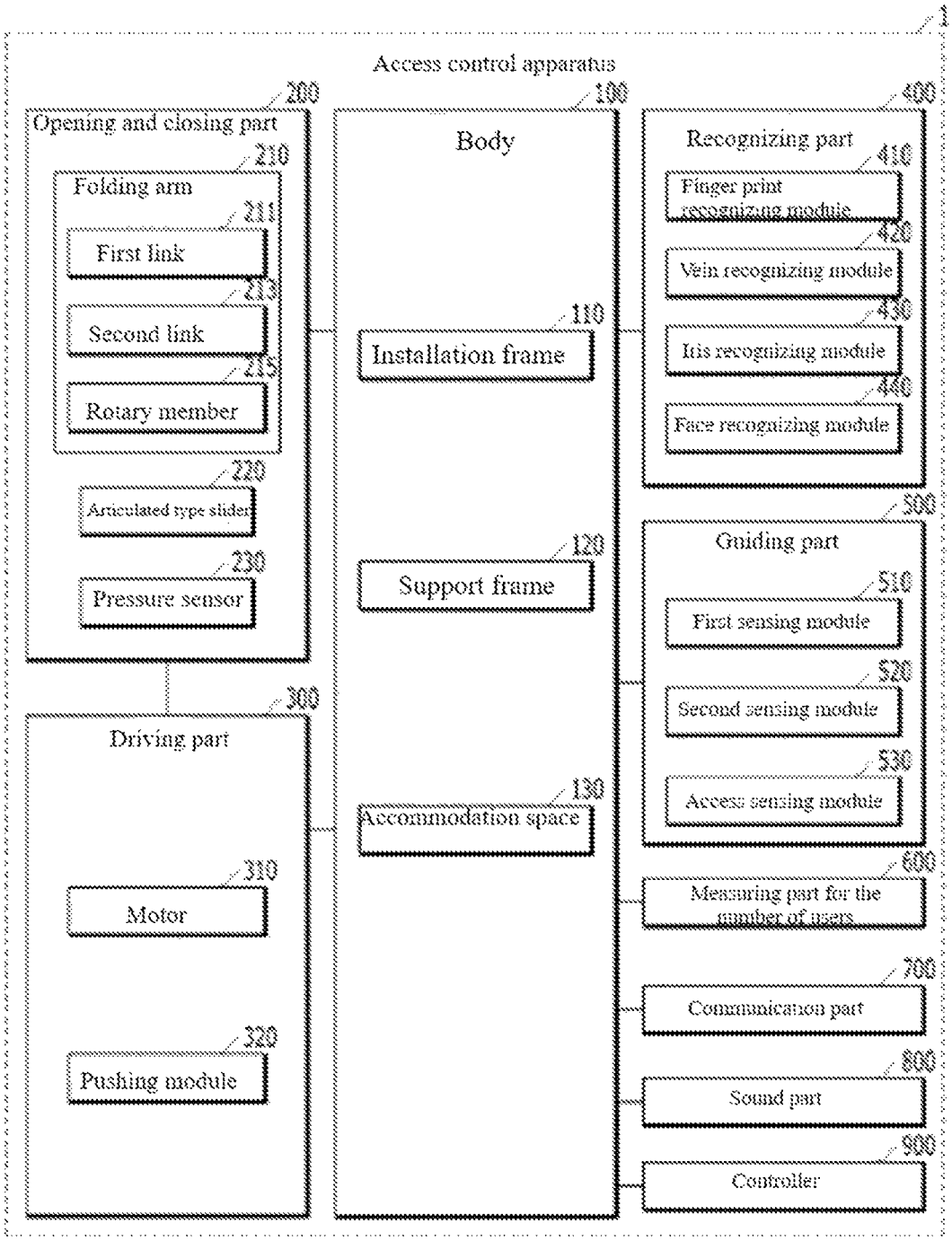
FIG. 2 is a block diagram showing a configuration of an access control apparatus according to the present invention.
Figure 3:
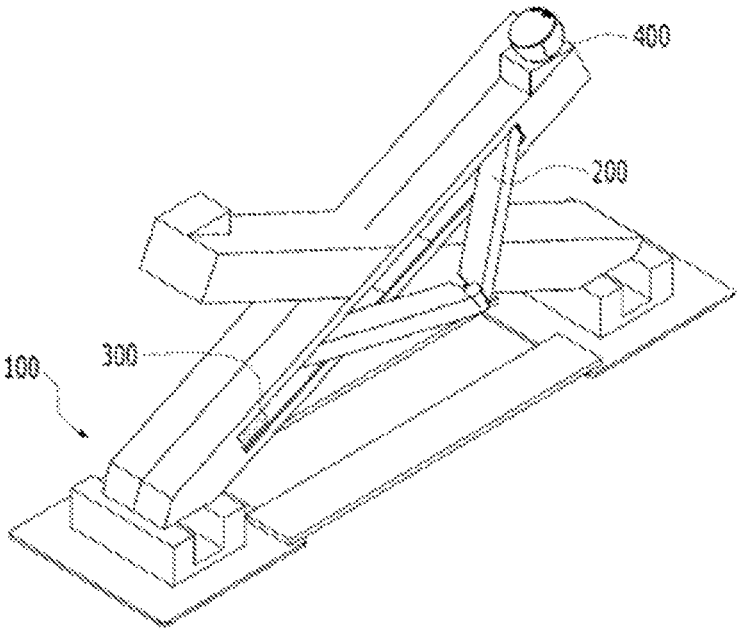
FIG. 3 is a schematic perspective view showing an outer appearance of the access control apparatus according to the present invention.

FIG. 2 is a block diagram showing a configuration of an access control apparatus according to the present invention, and FIG. 3 is a schematic perspective view showing an outer appearance of the access control apparatus according to the present invention.

An access control apparatus 1 for controlling a passage includes a body 100, an opening and closing part 200, and a driving part 300, and further, the access control apparatus 1 includes a recognizing part 400, a guiding part 500, a measuring part 600 for the number of users, a communication part 700, and a sound part 800.

The body 100 is located on the passage to form an outer appearance of the access control apparatus 1 and serves to support, protect and accommodate the respective parts of the access control apparatus 1. The body 100 includes an installation frame 110, a support frame 120, and an accommodation space 130.

The opening and closing part 200 is coupled to the body 100 and has a folding arm 210 changeable in an outer shape thereof. Further, the opening and closing part 200 serves to open and close the passage through the change of the outer shape to an opening mode and a closing mode and further includes an articulated type slider 220 and a pressure sensor 230.

The driving part 300 is coupled to the body 100 and serves to drive the opening and closing part 200 and also to control an operation of the opening and closing part 200. Further, the driving part 300 includes a motor 310 and a pushing module 320.

FIGS. 4A to 4D are front views showing various examples of the body 100 of the access control apparatus according to the present invention. Now, the body 100 will be explained in detail with reference to FIGS. 4A to 4D.

The body 100 includes the installation frame 110, the support frame 120, and the accommodation space 130.

The installation frame 110 is located on the floor of the passage, and the support frame 120 is located independently on the passage. Otherwise, the support frame 120 is coupled to the installation frame 110 located on the passage to support the whole access control apparatus 1. Further, the accommodation space 130 is formed on one surface of the body 100 to provide a seating space in which the opening and closing part 200 and the driving part 300 are coupled to the body 100.

Figure 4A:
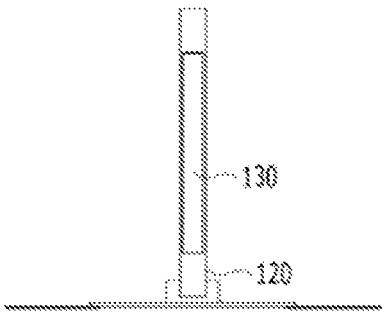
FIGS. 4A to 4D are front views showing various examples of a body of the access control apparatus according to the present invention.

As shown in FIG. 4A, if the support frame 120 is located independently on the passage, the installation frame 110 is not a necessary part of the access control apparatus 1. However, as shown in FIGS. 4B, 4C and 4D, the installation frame 110 is located on the passage, and the support frame 120 is coupled to the installation frame 110.

The installation frame 110 and the support frame 120 can be made of various materials. For example, the installation frame 110 and the support frame 120 are made of materials having high hardness like metals.

Figure 4B:
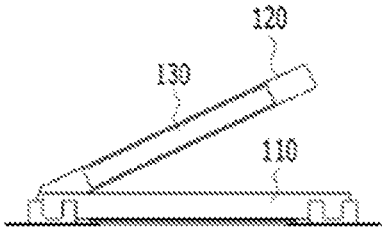
Figure 4C:
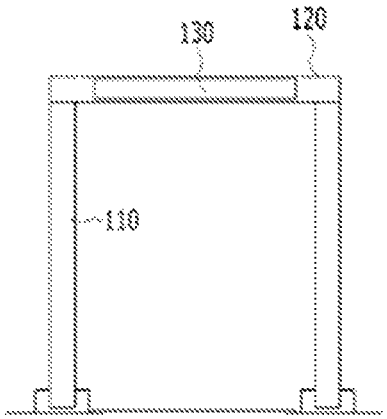
Figure 4D:
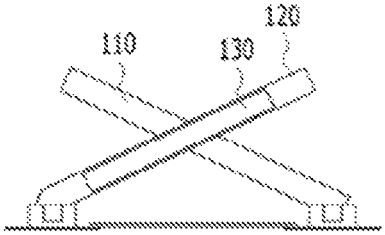

Particularly, the support frame 120 may have a vertical structure as shown in FIG. 4A, an octagonal structure as shown in FIG. 4B, a polygonal structure as shown in FIG. 4C, and an X-shaped or circular (not shown) structure as shown in FIG. 4D.

Further, one or more accommodation spaces 130 may be formed on the body 100. For example, the accommodation spaces 130 are formed symmetrically around the support frame 120 on both surfaces of the support frame 120.

Accordingly, two accommodation spaces 130 are formed on one support frame 120, and the opening and closing part 200 and the driving part 300 can be detachably attached or inserted into each accommodation space 130.

Also, the accommodation spaces 130 are formed inside the support frame 120 to provide seating spaces in which the opening and closing parts 200 and the driving parts 300 can be detachably attached or inserted. At this time, the opening and closing part 200 and the driving part 300 are located on the same shaft or rail to perform their function. Accordingly, a mechanism of the access control apparatus 1 can be simplified through such structures of the opening and closing part 200 and the driving part 300.

If the accommodation space 130 is formed on the interior or one surface of the support frame 120, the entire size of the access control apparatus 1 can be reduced. Through such a configuration of the access control apparatus 1, accordingly, the number of access control apparatuses 1 to be built in a restricted space can be increased, thereby increasing the number of users using an access control system having a plurality of access control apparatuses 1 within the same time.

Figure 5:
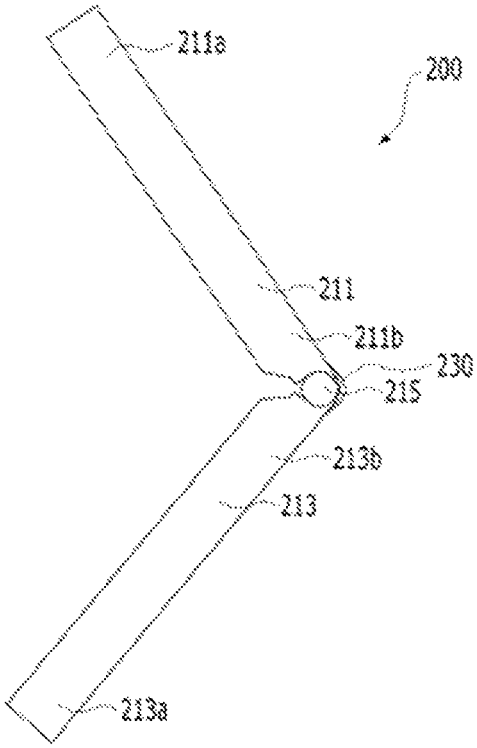
FIG. 5 is a perspective view showing a detailed configuration of an opening and closing part of the access control apparatus according to the present invention.
Figure 6:
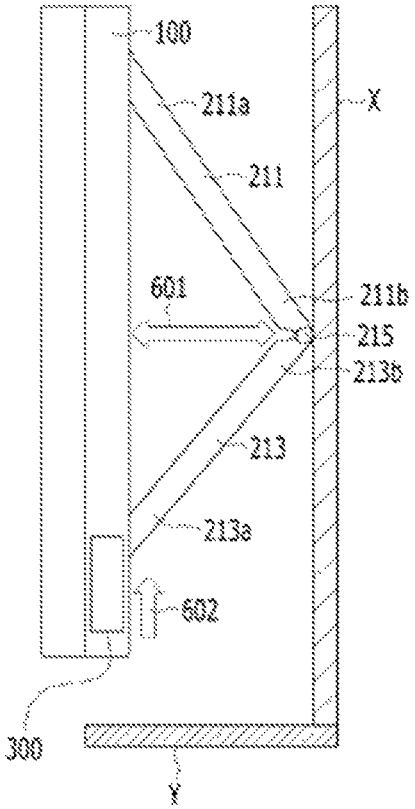
FIG. 6 is a sectional view showing a closing mode of the opening and closing part of the access control apparatus according to the present invention.
Figure 7:
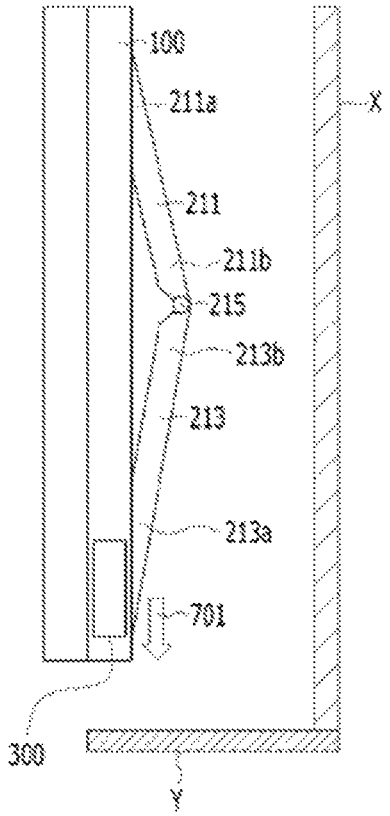
FIG. 7 is a sectional view showing an opening mode of the opening and closing part of the access control apparatus according to the present invention.

FIG. 5 is a perspective view showing a detailed configuration of the opening and closing part 200 of the access control apparatus according to the present invention, FIG. 6 is a sectional view showing a closing mode of the opening and closing part 200 of the access control apparatus according to the present invention, and FIG. 7 is a sectional view showing an opening mode of the opening and closing part 200 of the access control apparatus according to the present invention. Now, an explanation on the configuration and operation of the opening and closing part 200 of the access control apparatus 1 according to the present invention will be given in detail with reference to FIGS. 5 to 7.

The opening and closing part 200 has the folding arm 210.

Further, the access control apparatus 1 can have one or more opening and closing parts 200. For example, the opening and closing parts 200 may be located symmetrically around the support frame 120 on both surfaces of the support frame 120.

Referring again to FIG. 2, the opening and closing part 200 further has the pressure sensor 230.

The pressure sensor 230 is disposed on one side of the folding arm 210, and otherwise, it may be coupled to the outside of the folding arm 210. When the opening and closing parts 200 is changed to a closing mode, the pressure sensor 230 senses a given object inclusive of a user.

If the pressure sensor 230 senses a given object when the opening and closing part 200 is changed to the closing mode, the access control apparatus 1 can stop the operation of the opening and closing part 200. For example, in a state where a pair of access control apparatuses 1 is facingly built, if an object is caught between a pair of opening and closing parts 200, the pressure sensors 230 located on the outsides of the opening and closing parts 200 can sense the object, and accordingly, the access control apparatus 1 can rapidly stop the operations of the opening and closing parts 200 or change the opening and closing parts 200 into the opening modes.

Accordingly, the access control apparatus 1 can improve the safety for the user through the pressure sensor 230.

Moreover, the folding arm 210 of the opening and closing part 200 includes a first link 211, a second link 213, and a rotary member 215.

In detail, the folding arm 210 has the first link 211 whose one end 211*a* is rotatably coupled to the body 100 and the second link 213 whose one end 213*a* is coupled to the body 100 in such a manner as to be straightly moved by means of the driving part 300 and whose other end 213*b* is foldably coupled to the other end 211*b* of the first link 211.

Further, the first link 211 is located in the accommodation space 130 in such a manner as to allow one end 211*a* to be rotatably coupled to the support frame 120 of the body 100.

Also, the folding arm 210 includes the rotary member 215 having a circular shape in such a manner as to be coupled to the other end 211*b* of the first link 211 and to the other end 213*b* of the second link 213 to naturally fold the first link 211 and the second link 213.

In detail, the rotary member 215 serves to connect the first link 211 and the second link 213 to each other so that the first link 211 and the second link 213 can have a foldable structure.

If the folding arm 210 is changed into a folded structure in which the first link 211 and the second link 213 are folded, the opening and closing part 200 is changed to the closing mode, and contrarily, if the folding arm 210 is changed into an unfolded structure in which the first link 211 and the second link 213 are unfolded, the opening and closing part 200 is changed to the opening mode.

If the opening and closing part 200 is changed to the closing mode by means of the driving part 300, as shown in FIG. 6, one end 213*a* of the second link 213, which is movable in position, is moved to one end 211*a* of the first link 211 (in a direction of an arrow 602), and a portion corresponding to the center of the folding arm 210 in which the rotary member 215 is located protrudes in one direction. For example, the portion corresponding to the center of the folding arm 210 in which the rotary member 215 is located protrudes in a direction of a wall X. Accordingly, the access control apparatus 1 closes the passage Y so that it can control the access of the user.

If the opening and closing part 200 is changed to the opening mode, as shown in FIG. 7, one end 213*a* of the second link 213, which is movable in position, is moved to the opposite direction to one end 211*a* of the first link 211, and the portion of the rotary member 215 protruding at the time when the opening and closing part 200 is changed to the closing mode is moved to the opposite direction to one direction. For example, the portion corresponding to the center of the folding arm 210 in which the rotary member 215 is located is moved to the opposite direction (in the direction of the body 100) to the direction of the wall X.

In more detail, if the opening and closing part 200 is changed to the closing mode, the folding arm 210 is changed into the folded structure in which a portion thereof protrudes, and if the opening and closing part 200 is changed to the opening mode, the folding arm 210 is changed into the unfolded structure in which the protruding portion is returned to its original position.

If the folding arm 210 is changed into the unfolded structure from the folded structure, the access control apparatus 1 opens the closed passage Y again so that it can admit the access of the user thereto.

The opening mode and the closing mode of the opening and closing part 200 and the folded structure and the unfolded structure of the folding arm 210 are terms used to distinguish them. Accordingly, the opening mode and the closing mode of the opening and closing part 200 and the folded structure and the unfolded structure of the folding arm 210 are mutually related to each other, while being not generated with given standards like time intervals.

As shown in FIGS. 6 and 7, a protruding length 610 of the portion of the rotary member 215 when the folding arm 210 is changed into the folded structure is longer than the moving length 601 or 701 of one end 213*a* of the second link 213 when the folding arm 210 is changed into the folded structure, In detail, if it is assumed that the first link 211 and the second link 213 have the same length as each other, the entire length of the folding arm 210 is defined as 'a', a moving length of one end 213*a* of the second link 213 as 'b', a protruding length of the portion of the rotary member 215 when the folding arm 210 is changed into the folded or unfolded structure as 'c', and an angle of the second link 213 with respect to the moving direction of one end 213*a* of the second link 213 as 'θ', and in this case, the following equation (1) is given.

$$\frac{b}{c} = \frac{2(1-\cos\theta)}{\sin\theta} \qquad \text{Equation (1)}$$

If the angle θ having a value between 0° and 90° has a value between 0° and about 53.13°, accordingly, the moving length b of one end 213*a* of the second link 213 is shorter than the protruding length c of the portion of the rotary member 215 when the folding arm 210 is changed into the folded or unfolded structure. If the angle θ has a value between about 53.13° and 90°, also, the moving length b of one end 213*a* of the second link 213 is longer than the protruding length c of the portion of the rotary member 215 when the folding arm 210 is changed into the folded or unfolded structure.

As a result, if the angle θ is controlled to allow the protruding length c (601) of the portion of the rotary member 215 when the folding arm 210 is changed into the folded or unfolded structure to be longer than the moving length b (602 or 701) of one end 213*a* of the second link 213, the access control apparatus 1 can have the opening and closing length c (601) longer than the relatively short straight moving length b (602 or 701). Accordingly, the access control apparatus 1 can have an effect capable of increasing the opening and closing speed of the opening and closing part 200.

Figure 8:
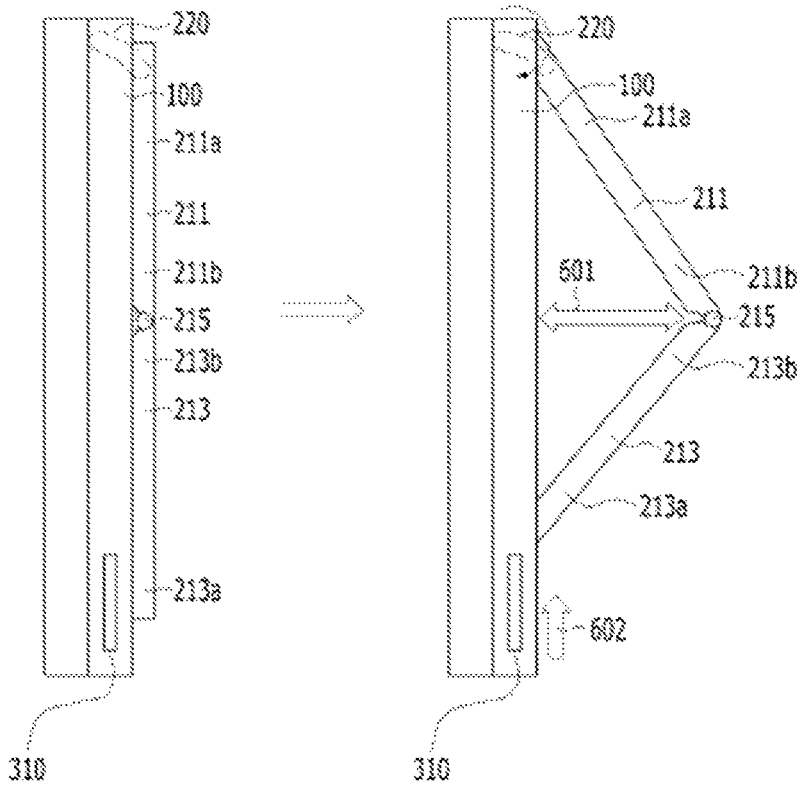
FIG. 8 is a sectional view showing a variation example of the opening and closing part using an articulated type slider in the access control apparatus according to the present invention.

FIG. 8 is a sectional view showing a variation example of the opening and closing part 200 using the articulated type slider 220 in the access control apparatus according to the present invention.

The motor 310 provides power for driving the opening and closing part 200, and referring to FIG. 2, the opening and closing part 200 further includes the articulated type slider 220.

The articulated type slider 220 is rotatably coupled to the first link 211 and is located in the accommodation space 130.

Also, the articulated type slider 220 has a shoulder joint structure adapted to allow the folding arm 210 to be naturally changed from the straight structure into the folded structure.

In detail, if the folding arm 210 with the straight structure in which the first link 211, the second link 213, and the rotary member 215 are arranged in series is located in the accommodation space 130, the articulated type slider 220 can slide the first link 211 to allow the folding arm 210 to be changed from the straight structure into the folded structure in which the folding arm 210 protrudes outward from the accommodation space 130.

Since the opening and closing part 200 further includes the articulated type slider 220, the folding arm 210 can be naturally changed into the folded structure even if it has the straight structure in the accommodation space 130 during it is changed repeatedly to the opening mode and the closing mode. In detail, the access control apparatus 1 is configured to allow the driving part 300 to drive the second link 213, even if no separate power is supplied to the articulated type slider 220, so that the folding arm 210 can be changed into the folded structure.

So as to control the operation of the opening and closing part 200, if the motor 310 is operated to allow one end 213*a* of the second link 213 to be moved to the first link 211, the articulated type slider 220 having the shoulder joint structure can be folded like a real shoulder joint of the human body, so that the first link 211, the second link 213, and the rotary member 215 can be changed into the folded structure.

Figure 9:
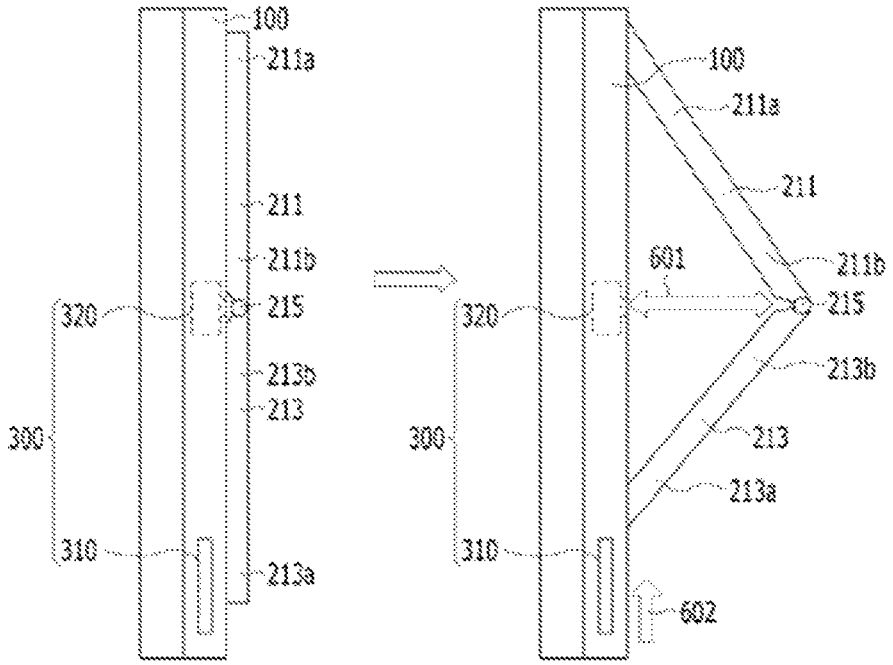
FIG. 9 is a sectional view showing another variation example of the opening and closing part using a pushing module in the access control apparatus according to the present invention.

FIG. 9 is a sectional view showing another variation example of the opening and closing part 200 using a pushing module 320 in the access control apparatus according to the present invention.

In addition to the motor 310, the driving part 300 further includes the pushing module 320.

The pushing module 320 serves to push the folding arm 210 with the power supplied from the motor 310.

If the first link 211, the second link 213, and the rotary member 215 are arranged in series to allow the folding arm 210 to be positioned with the straight structure in the accommodation space 130, the pushing module 320 pushes the folding arm 210 toward the outside of the accommodation space 130 so as to allow the folding arm 210 to be changed from the straight structure into the folded structure in which the folding arm 210 protrudes outward from the accommodation space 130. Accordingly, the pushing module 320 can be mounted in the accommodation space 130 of the body 100.

Further, the motor 310 can be a ball-screw type motor or linear type motor, but it is not necessarily limited to the linear type motor.

If the motor 310 is the linear type motor, no noise occurs during the operation of the opening and closing part 200 according to the characteristics of the linear type motor. Accordingly, the access control apparatus 1 further includes the sound part 800 serving as a speaker.

While the opening and closing part 200 is being controlled or operated by means of the driving part 300, the sound part 800 can provide predetermined sounds to the user of the access control apparatus 1. For example, the predetermined sounds include robot sounds, mechanical sounds, voices and songs of specific persons, and the sounds are stored as data in the sound part 800.

Figure 10:
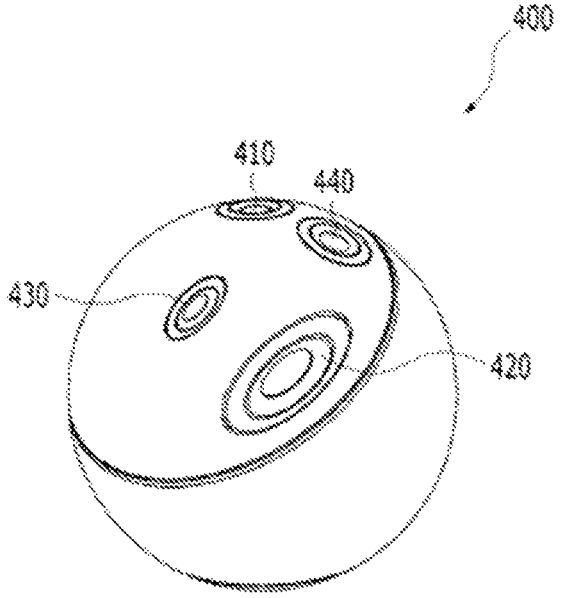
FIG. 10 is a perspective view showing a detailed configuration of a recognizing part of the access control apparatus according to the present invention.

FIG. 10 is a perspective view showing a detailed configuration of the recognizing part 400 of the access control apparatus according to the present invention, and the recognizing part 400 will be in detail explained with reference to the above-mentioned description and FIG. 10.

The access control apparatus 1 can admit access to access-admitted persons through the recognizing part 400. The recognizing part 400 includes at least one or more modules selected from a finger print recognizing module 410 for recognizing the finger print of the user of the access control apparatus 1, a vein recognizing module 420 for recognizing the vein shape of the user of the access control apparatus 1, an iris recognizing module 430 for recognizing the iris of the user of the access control apparatus 1, and a face recognizing module 440 for recognizing the facial shape of the user of the access control apparatus 1.

The recognizing part 400 can recognize the user of the access control apparatus 1 through only one of the four recognizing modules 410, 420, 430 and 440, but if it is necessary to enhance a security level, the recognizing part 400 recognizes the user of the access control apparatus 1 through all of the four recognizing modules 410, 420, 430 and 440.

Further, the recognizing part 400 further includes a storage (not shown) or user register (not shown) having a database form in which user information having at least one or more pieces of information selected from finger print, vein, iris, and face information of the user is stored.

The recognizing part 400 compares user information in advance stored in the storage (not shown) or the user register (not shown) with the user's finger print, vein shape, iris, and facial shape recognized through the respective modules 410, 420, 430 and 440, and if the user information corresponds to the recognized user information, the access control apparatus 1 can change the opening and closing part 200 to the opening mode through the driving part 300. Contrarily, if not, the access control apparatus 1 can keep the opening and closing part 200 to the closing mode through the driving part 300.

In addition, if the user information does not correspond to the recognized user information through the recognizing part 400, the access control apparatus 1 can provide predetermined sounds through the sound part 800. For example, if the user information does not correspond to the recognized user information through the recognizing part 400, the access control apparatus 1 can provide sounds like "You are not admitted" or "Please let me recognize you again" through the sound part 800.

Further, the respective modules 410, 420, 430 and 440 can sense the finger print, the vein shape, the iris, and the facial shape to be recognized through an optical method using cameras. At this time, the respective modules 410, 420, 430 and 440 are close to each other so that the access control apparatus 1 can enhance a user recognizing efficiency.

Furthermore, if the recognizing part 400 has a shape of a ball or column, the respective modules 410, 420, 430 and 440 are located at the hollow interior of the recognizing part 400, and a housing made of a transparent material like glass is mounted on the outer periphery of the recognizing part 400.

Also, the recognizing part 400 can perform the recognition for the finger print or vein shape of the user even if the user's body does not come into direct contact therewith, and further, the recognizing part 400 can perform the recognition for the facial shape or iris shape of the user even while the user is accessing thereto.

The user information recognized or acquired by the recognizing part 400 can be called user biological data having at least one of the finger print, vein, iris, and facial shapes of the user. The respective modules 410, 420, 430 and 440 can recognize or acquire the user biological data sensible thereby, independently of each other.

If the recognizing part 400 includes all of the modules 410, 420, 430 and 440, the access control apparatus 1 can open the opening and closing part 200 even in a case where a portion of the user biological data sensed by the modules 410, 420, 430 and 440 is recognized. For example, even if only the finger print sensing through the finger print recognizing module 410 is finished, the access control apparatus 1 can open the opening and closing part 200. Accordingly, the recognizing speed of the recognizing part 400 can be increased, and also, the driving speed for opening and closing the access control apparatus 1 can be raised.

Figure 11:
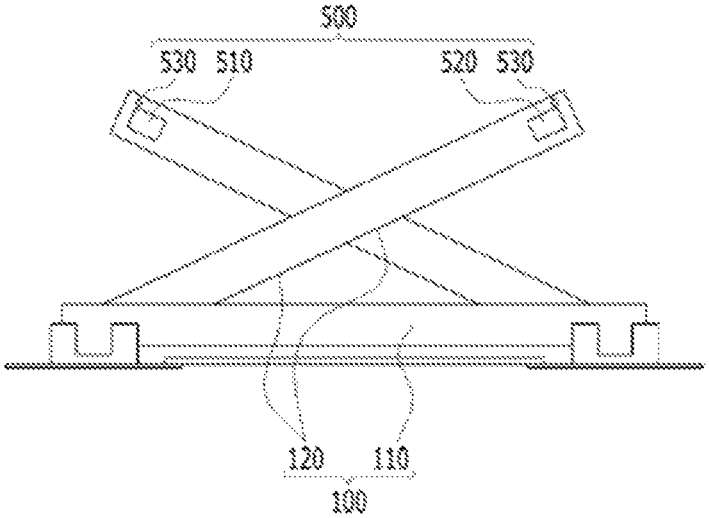
FIG. 11 is a side view showing a detailed configuration of a guiding part of the access control apparatus according to the present invention.

FIG. 11 is a side view showing a detailed configuration of the guiding part 500 of the access control apparatus according to the present invention.

The guiding part 500 serves to sense users of the access control apparatus 1. If a plurality of users is sensed, further, the guiding part 500 performs access guiding to the access control apparatus 1 for the users, thereby improving the user's conveniences in use.

In detail, the guiding part 500 includes a first sensing module 510 disposed on one end of the body 1, a second sensing module 520 disposed on the other end of the body 1, and access guiding modules 530. The first sensing module 510 and the second sensing module 520 are located on the access control apparatus 1, but of course, they may be located on positions separated from the access control apparatus 1.

The access control apparatus 1 is installed on the passage to control the access to the passage, and in this case, generally, the user can be accessed to two ways of the access control apparatus 1. Accordingly, the first sensing module 510 and the second sensing module 520 are located symmetrically to each other on both ends of the support frames 120 around the support frames 120.

One or more access guiding modules 530 are located on the access control apparatus 1. For example, if two access guiding modules 530 are located on the access control apparatus 1, they are located at the positions close to the first sensing module 510 and the second sensing module 520 so as to guide the two-way users.

The first sensing module 510 serves to sense one side user of the access control apparatus 1 to measure a distance from the sensed user. The second sensing module 520 serves to sense the other side user of the access control apparatus 1 to measure a distance from the sensed user.

If any one of the first sensing module 510 and the second sensing module 520 senses the user, after that, the guiding part 500 can guide the sensed user to the access control apparatus 1 through the access guiding module 530. If both of the first sensing module 510 and the second sensing module 520 sense the users, further, the guiding part 500 can guide the first sensed user in the sensed order to the access control apparatus 1 through the access guiding module 530, and otherwise, the guiding part 500 can guide the closer user on the basis of the sensed distance to the access control apparatus 1 through the access guiding module 530.

In detail, the guiding part 500 performs access guiding for the sensed users according to various standards like the sensed order or distance and also guides the plurality of users to different ways.

Further, the guiding part 500 compares a distance from one side user measured through the first sensing module 510 with a distance from the other side user measured through the second sensing module 520 and guides one side user and the other side user to the access control apparatus 1 through the access guiding modules 530. At this time, the access guiding modules 530 can provide first access to the access control apparatus 1 for one side user or the other side user by means of lighting of LEDs. The access guiding module 530 does not have any limitations in a method and form in lighting the LEDs.

For example, if it is desired that the plurality of users simultaneously accesses to the access control apparatus 1, the first sensing module 510 and the second sensing module 520 mounted at the symmetrical positions of the access control apparatus 1 sense the users located at their respective positions and measure the distances from the users.

After that, the guiding part 500 compares the distance measured through the first sensing module 510 with the distance measured through the second sensing module 520, and the guiding part 500 thus guides the user located at the closer distance by displaying the LEDs indicating an arrow mark or a phrase "allowed" through the access guiding module 530, while guiding the user located at a relatively long distance by displaying the LEDs indicating an X mark or a phrase "not allowed" or "Please wait for a while" through the access guiding module 530.

As a result, the access control apparatus 1 can increase the user conveniences and prevent collision between the plurality of users and the access control apparatus 1 when the plurality of users simultaneously access thereto.

Referring back to FIG. 2, as mentioned above, the access control apparatus 1 further includes the measuring part 600 for the number of users thereof, the communication part 700 for transmitting and receiving the information related thereto to and from a predetermined terminal, and a controller 900 for monitoring the information related thereto.

The measuring part 600 for the number of users and the communication part 700 are also located on the access control apparatus 1.

The communication part 700 is interlocked with the predetermined terminal wirelessly and transmits the information related to at least one or more parts of the body 100, the opening and closing part 200, the driving part 300, the recognizing part 400, the guiding part 500, the measuring part 600 for the number of users, the communication part 700 and the sound part 800 to the predetermined terminal.

The communication part 700 makes use of wireless communication technology when it transmits the information. For example, the communication part 700 makes use of wireless communication technology such as Bluetooth, Zigbee, LTE, and Wi-Fi, but of course, it is not limited thereto.

The predetermined terminal is a communicable digital device. For example, the predetermined terminal includes a smart phone, a smart pad, a smart glass, a smart winch, a laptop, a computer, or PDA, but of course, it is not limited thereto.

The measuring part 600 for the number of users measures the number of users of the access control apparatus 1 through at least one or more information selected from information on the number of driving times of the opening and closing part 200, information on the number of times changed into the folded and unfolded structures of the folding arm 210, information on the number of times for the user recognition of the recognizing part 400, and information on the number of times for user access guiding of the guiding part 500. Also, the measuring part 600 for the number of users can measure the number of users according to given standards like the number of users for a day, the number of users during specific time.

The information transmitted from the communication part 700 to the predetermined terminal includes at least one or more information selected from error information related to at least one or more parts of the body 100, the opening and closing part 200, the driving part 300, the recognizing part 400, the guiding part 500, the measuring part 600 for the number of users, the communication part 700 and the sound part 800, information on the number of driving times of the opening and closing part 200, information on the number of times changed into the folded and unfolded structures of the folding arm 210, information on the number of times for the user recognition of the recognizing part 400, information on the number of times for user access guiding of the guiding part 500, and information on the number of users of the access control apparatus 1 measured by the measuring part 600.

The controller 900 serves to display the information related to the access control apparatus 1 by means of a display module (not shown). Further, the controller 900 serves to monitor the information related to the access control apparatus 1 by means of separate software or to change setting of the respective parts of the access control apparatus 1.

For example, the controller 900 performs mode changes of the opening and closing part 200, recognition method setting and changes of the recognizing part 400, guiding method setting and changes of the guiding part 500, information transmission to the predetermined terminal through the communication part 700, sound setting and changes of the sound part 800, and error information acquisition and display of the respective parts of the access control apparatus 1.

Through the information transmission and reception of the communication part 700, the predetermined terminal can perform analysis, management and error analysis of the information related to the access control apparatus 1. Through control software of the access control apparatus 1 stored in the predetermined terminal, further, the access control apparatus 1 can be repaired or managed remotely. Even if the access control apparatus 1 is not disassembled, also, the controller 900 can change the setting of the access control apparatus 1 and monitor the access control apparatus 1. Accordingly, conveniences for the manager of the access control apparatus 1 can be improved.

Figure 12:
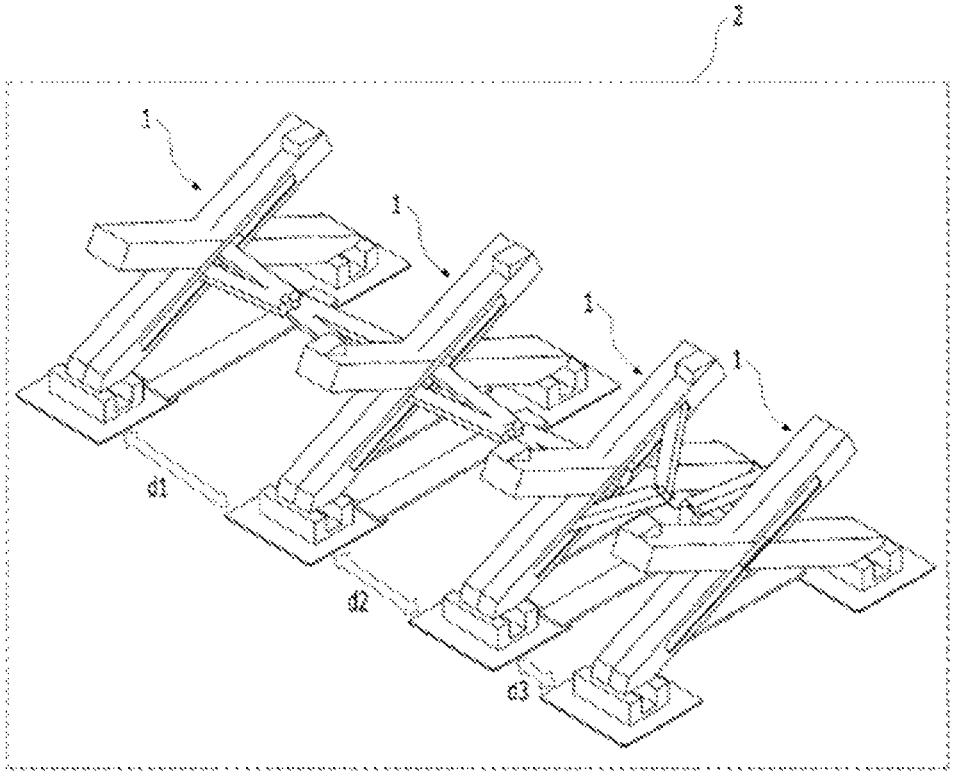
FIG. 12 is a perspective view showing an access control system having the plurality of access control apparatuses according to the present invention.

FIG. 12 is a perspective view showing an access control system 2 having the plurality of access control apparatuses 1 according to the present invention, and the access control system 2 will be in detail explained with reference to FIGS. 2 to 12.

The access control system 2 has the plurality of access control apparatuses 1 spaced apart from each other by given distances so as to form respective passages, and the access control apparatuses 1 may be paired two of each with each other in such a manner as to face each other.

Also, the access control system 2 controls the protruding lengths (the protruding lengths of the portions of the rotary members 215) when the folding arms 210 of the respective access control apparatuses 1 are changed into the folded structures, thereby adjusting the given distances between the access control apparatuses 1.

When the plurality of access control apparatuses 1 is located, accordingly, a size of a space occupied by the access control system 2 can be freely adjusted as shown in FIG. 12.

When various widths d1, d2 and d3 of the access control system 2 as shown in FIG. 12 are compared with each other, the width d1 is the largest width among the widths d1, d2 and d3 of the access control system 2 having the plurality of access control apparatuses 1, the width d2 is smaller than the width d1 but larger than the width d3, and the width d3 is the smallest width among the widths d1, d2 and d3.

If the installation widths of the plurality of access control apparatuses 1 are freely set to constitute the access control system 2, a reinstallation cost of the access control apparatuses 1 can be reduced, and space utility can be enhanced.

If the opening and closing parts 200 and the driving parts 300 are located on both surfaces of the support frame 120 and the recognizing parts 400 are located in two directions of the access control apparatus 1, as mentioned above, space utility of the access control system 2 can be enhanced.

The functions of the above-mentioned access control apparatus 1 and the access control system 2 can be carried out by means of external power or batteries built therein. Further, the respective parts of the access control apparatus 1 can be connected or interlocked with each other wiredly or wirelessly, and the functions of the respective parts can be controlled, independently of each other. However, they are not necessarily controlled, independently of each other, and of course, they are controlled in such a manner as to be physically or electrically dependent on each other.

When compared with the conventional access control apparatus wherein the passage is open and closed through the door having a predetermined size, the access control apparatus 1 according to the present invention can reduce the width of the support frame 120, so that the access control system 2 having the plurality of access control apparatuses 1 can be reduced in an installation width thereof.

If the installation width of the access control system 2 is reduced, the number of access control apparatuses 1 constituting the access control system 2 is increased in a restricted space, so that the number of users using the access control system 2 within predetermined time can be increased, thereby resulting in the increment in a handling capacity as a standard for estimating the performance of the access control system 2.

According to the present invention, further, the installation width between the access control apparatuses 1 can be freely set, so that the access control apparatuses 1 can be installed appropriately according to various passage widths.

Also, the protruding length 610 of the folding arm 210 of the opening and closing part 200 is larger than the straight moving length 601 or 701 of one end 213*a* of the second link 213 by means of the driving part 300, so that the driving speed of the opening and closing part 200 can be faster than those of the slide type gate and the swing type gate in the conventional practices. If the driving speed of the access control apparatus 1 is increased, the reliability and economical effects of the access control apparatus 1 can be also improved.

If the straight moving length 601 or 701 of one end 213*a* of the second link 213 by means of the driving part 300 is shorter than the protruding length 610 of the folding arm 210, it means that the moving distance of the opening and closing part 200 through the driving part 300 is shorter than a width of the passage open and closed by means of the real movement of the opening and closing part 200. When compared with the existing slide type gate and swing type gate wherein the moving distance of the opening and closing part through the driving part is equal to a width of the passage open and closed by means of the real movement of the opening and closing part, accordingly, the access control apparatus 1 according to the present invention can have the driving part 300 having more excellent durability than the existing driving part and also have high energy efficiency.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. For example, the parts expressed in a singular form may be dispersedly provided, and in the same manner as above, the parts dispersed may be combined with each other. The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

The invention claimed is:

1. An access control apparatus comprising:

a body configured to be located on a passage;

an opening and closing part coupled to the body and having a folding arm adapted to open and close the passage; and a driving part coupled to the body to control an operation of the opening and closing part, wherein the folding arm includes a first link and a second link, the first link having a first end rotatably coupled to the body and a second end positioned opposite to the first end of the first link, the second link having a first end coupled to the body to be straightly moved by the driving part and a second end positioned opposite to the first end of the second link, the second end of the second link being coupled to the second end of the first link, and wherein the first end of the second link is configured to be moved to be closer to the first end of the first link such that the second end of the second link coupled to the second end of the first link moves to be farther from the body.

2. The access control apparatus according to claim 1, wherein the driving part includes a linear motor to control the operation of the opening and closing part through the linear motor.

3. The access control apparatus according to claim 1, further comprising a sound part adapted to provide predetermined sounds to a user of the access control apparatus, while the opening and closing part is being controlled by the driving part.

4. An access control system comprising a plurality of access control apparatuses according to claim 1, wherein the plurality of access control apparatuses is spaced apart from each other by given distances, and the given distances are set by controlling protruding lengths of the folding arms of the plurality of access control apparatuses.

5. An access control apparatus comprising:

a body configured to be located on a passage;

an opening and closing part coupled to the body and having a folding arm adapted to open and close the passage; and a driving part coupled to the body to control an operation of the opening and closing part, wherein the folding arm includes a first link and a second link, the first link having a first end rotatably coupled to the body and a second end positioned opposite to the first end of the first link, the second link having a first end coupled to the body to be straightly moved by the driving part and a second end positioned opposite to the first end of the second link, the second end of the second link being coupled to the second end of the first link, and wherein the body includes a support frame having an accommodation space adapted to allow the opening and closing part and the driving part to be detachably attached or inserted thereinto, the opening and closing part further includes a pressure sensor disposed on one side of the folding arm, and the folding arm further includes a rotary member having a circular shape to be coupled to the second end of the first link and to the second end of the second link to connect the first link and the second link to each other.

6. The access control apparatus according to claim 5, wherein the accommodation space is formed symmetrically in the support frame.

7. The access control apparatus according to claim 5, wherein the opening and closing part is configured to be closed by the driving part, when the first end of the second link is moved to the first end of the first link to allow a portion of the folding arm around the rotary member to protrude from the accommodation space so that the folding arm is in a folded position, and wherein the opening and closing part is configured to be opened by the driving part, when the first end of the second link is moved back from the first end of the first link to allow the portion of the folding arm to return to the accommodation space so that the folding arm is in an unfolded position.

8. The access control apparatus according to claim 7, wherein the opening and closing part further includes a slider located in the accommodation space to be rotatably coupled to the first link, and the slider has a shoulder joint structure so as to allow the position of the folding arm to be changed into the folded position from the unfolded position.

9. The access control apparatus according to claim 7, wherein the driving part further includes a pushing module adapted to push the folding arm toward an outside of the accommodation space when the folding arm in the unfolded position is located in the accommodation space.

10. The access control apparatus according to claim 7, further comprising a guiding part adapted to guide a plurality of uses of the access control apparatus and having a first sensing module disposed on one end of the support frame to sense one user of the access control apparatus, a second sensing module disposed on another end of the support frame symmetrical to the one end of the support frame to sense another user of the access control apparatus, and access guiding modules for guiding accesses to the access control apparatus, so that when any one of the first sensing module and the second sensing module senses one user, the guiding part guides the sensed user to the access control apparatus through the corresponding access guiding module, and when both of the first sensing module and the second sensing module sense two or more users, the guiding part guides the first sensed user in a sensed order to the access control apparatus through the corresponding access guiding module or guides the closest user on the basis of a sensed distance to the access control apparatus through the corresponding access guiding module.

11. The access control apparatus according to claim 10, wherein the access guiding modules provide first access to the access control apparatus for one user or another user by means of lighting of LEDs toward one user or another user or guide one user and another user to different ways.

12. An access control system comprising a plurality of access control apparatuses according to claim 5, wherein the plurality of access control apparatuses is spaced apart from each other by given distances, and the given distances are set by controlling protruding lengths of the folding arms of the plurality of access control apparatuses.

13. An access control apparatus comprising:

a body configured to be located on a passage;

an opening and closing part coupled to the body and having a folding arm adapted to open and close the passage; and a driving part coupled to the body to control an operation of the opening and closing part, wherein the folding arm includes a first link and a second link, the first link having a first end rotatably coupled to the body and a second end positioned opposite to the first end of the first link, the second link having a first end coupled to the body to be straightly moved by the driving part and a second end positioned opposite to the first end of the second link, the second end of the second link being coupled to the second end of the first link, and wherein the access control apparatus further comprises a recognizing part located on one side thereof and having at least one or more modules selected from a finger print recognizing module for recognizing a finger print of a user of the access control apparatus, a vein recognizing module for recognizing a vein shape of the user, an iris recognizing module for recognizing an iris of the user, and a face recognizing module for recognizing a facial shape of the user to recognize the user of the access control apparatus, so that the access control apparatus opens the opening and closing part by the driving part when the recognized user of the access control apparatus is an access-admitted person.

14. An access control system comprising a plurality of access control apparatuses according to claim 13, wherein the plurality of access control apparatuses is spaced apart from each other by given distances, and the given distances are set by controlling protruding lengths of the folding arms of the plurality of access control apparatuses.

* * * * *